US005193726A

United States Patent [19]

Humphrey

[11] Patent Number: 5,193,726

[45] Date of Patent: Mar. 16, 1993

[54] SHEET MATERIAL DISPENSING APPARATUS

[76] Inventor: Paula Humphrey, 3642 Anthony Dr. #1D, Mesquite, Tex. 75150

[21] Appl. No.: 827,286

[22] Filed: Jan. 29, 1992

[51] Int. Cl.[5] ..... B26F 3/02

[52] U.S. Cl. ..... 225/4; 225/39; 225/44; 225/52; 225/85; 206/390; 206/409; 312/297

[58] Field of Search ..... 225/4, 39, 43, 44, 46, 225/51, 52, 89, 85; 206/39, 389, 390, 398, 399, 401, 409; 221/26, 64, 282; 312/39, 40, 41, 297

[56] References Cited

U.S. PATENT DOCUMENTS

| | | | |
|---|---|---|---|
| 236,820 | 1/1881 | Jones | 312/41 |
| 691,673 | 1/1902 | Stockton | 242/55.53 |
| 725,170 | 4/1903 | Stewart | 312/297 X |
| 870,445 | 11/1907 | Livermore | 206/39 X |
| 943,279 | 12/1909 | Smith | 312/39 |
| 2,003,044 | 6/1935 | Galante | 225/44 X |
| 2,869,955 | 1/1959 | La Rue | 312/297 |
| 3,249,273 | 5/1966 | Robinson | 225/16 |
| 3,418,029 | 12/1968 | Wooster | 312/39 |
| 3,870,391 | 3/1975 | Nims | 312/297 |
| 3,936,113 | 2/1976 | Anderson | 312/297 |
| 4,113,195 | 9/1978 | Theunissen | 242/55.3 |
| 4,191,307 | 3/1980 | LeCaire, Jr. et al. | 221/45 |
| 4,432,482 | 2/1984 | Beausoleil | 225/46 X |
| 4,690,344 | 9/1987 | Yokota | 242/55.53 |
| 4,714,191 | 12/1987 | Richardson | 229/121 |
| 4,721,264 | 1/1988 | Muscarello | 242/55.53 |
| 4,805,794 | 2/1989 | Tsuchiya et al. | 206/389 X |
| 4,850,486 | 7/1989 | Neibaur | 206/390 |
| 5,000,340 | 3/1991 | Leggio | 220/407 |

*Primary Examiner*—Frank T. Yost
*Assistant Examiner*—Raymond D. Woods
*Attorney, Agent, or Firm*—Hubbard, Thurman, Tucker & Harris

[57] ABSTRACT

Closure usable for dispensing tear off lengths of rolled sheet materials, including plastic trash can liners. A 'roll top' door is included which incorporates in it a roller mechanism. The lower supporting body of the apparatus also has provided a roller mechanism. When the roll top door is closed, the roller on the door is brought into contact with the roller on the apparatus. When used, the door on the apparatus is opened and a store of sheet material to be dispensed is placed within the apparatus. An amount of sheet material to be dispensed is played out over the lower roller. When the door of the device is closed, the top roller is brought into contact with the upper surface of the sheet material to be dispensed. The friction between the upper and lower roller provides tension on the sheet material when sheet material is pulled from the apparatus.

19 Claims, 2 Drawing Sheets

SHEET MATERIAL DISPENSING APPARATUS

BACKGROUND OF THE INVENTION

The applicable art to the present invention relates generally to dispensing devices for flat, film-like products, and more specifically, multiple plastic trash bag liners connected by perforations. The art to which this invention relates has become increasingly crowded with complex devices which are difficult to use and expensive to manufacture.

Many various types of sheet material dispening devices are known in the prior art. For example, it is well known in the art to provide a central spindle within an enclosure to hold a roll of the material to be dispensed. U.S. Pat. No. 943,279 by Smith discloses such a device. Further, Smith discloses a complex mechanism to extend free material from the roll. This mechanism includes a complex system of gears, ratchets, and feed rollers to allow one-way extension of material to be dispensed. Smith discloses a first feed roller pivotally connected to a top "door" and a lower feed roller pivotally connected to the base of the enclosure. When the device is loaded with material to be dispensed, the "door" is opened, rolled product on a spindle is inserted, and partially extended on top of the lower roller. The "door" is then closed bringing the top roller into contact with the top surface of the product to be dispensed.

While the arrangement discussed by Smith allows some control over the dispensed product, it is relatively complex and expensive to construct. Further, it does not achieve a quick and easy method of loading material to be dispensed. Additionally, the device is limited to dispensing rolled material which is suitable for suspension on a spindle.

A similar product dispensing apparatus is disclosed in U.S. Pat. No. 4,690,344 by Yokota. Yokota teaches that a roll of thin, film-like products suspended by a spindle may be dispensed by a sandwiching the film between a set of electrically actuated rollers. The Yokota device discloses an enclosure having a top hinged at the rear to a base. The top is provided with a spring loaded roller, while the base is provided with a motor driven roller. When a product is inserted, the top is closed bringing the top roller into contact with the lower roller, thereby sandwiching the product to be dispensed. Yokota also discloses complex sensing devices enabling the user to determine whether the product is present between the rollers.

As with Smith, the implementation of the Yokota device is relatively expensive and complex, requiring electric motors, sensing devices, and a source of power. Unfortunately, the Yokota device is only adapted to dispense material rolled about a spindle, much like Smith. This limitation greatly reduces the number and type of products which the Yokota device can dispense.

U.S. Pat. No. 3,418,029 by Wooster discloses an enclosure for dispensing sheet materials in rolled form, similar to that disclosed in Smith and Yokota; however, Wooster has the advantage of a swinging door that is hinged in such a way that the entire device may be placed with its back against the wall or other similar vertical surface. A distinct disadvantage of a hinged, rigged top which swings upward, is that the device may not be placed against a horizontal surface, such as the bottom of the cabinet or shelf without interfering with the opening of the top.

Wooster also discloses a complex series of worm gears which drive a pair of rollers to play out product to be dispensed. As a crank handle is turned, succeeding product is dispensed.

As with Smith and Yokota, Wooster has a disadvantage of complexity and expense. Also, as with Yokota and Smith, the Wooster device requires a rigid lid which must be opened upward in order for sheet product to be replaced. The rigid lid limits the replacement of the entire device to vertical surfaces. Additionally, the Wooster device is limited to dispensing materials rolled about a central spindle.

The prior art also discloses many devices which employ a wide opening for dispensing plastic bags and the like.

U.S. Pat. No. 4,191,307 by LeCaire, Jr. et al discloses a plastic wall-mounted dispenser for rolled sheet material. Essentially, the device is a box with an open portal through which plastic bags are fed. The box is constructed of a base and a lid whose structure is designed to maximize the strength of the container. The LeCaire device makes no provision for tearing one bag from the succeeding bag after it is withdrawn from the container. This is disadvantageous because the bag to be dispensed may be damaged through the uneven force of tearing the perforations between the bags, or more than one bag may be unknowingly withdrawn from the container.

U.S. Pat. No. 4,850,486 by Neibaur discloses a disposable trash bag storage and dispensing box. The box is fitted with a removable portion which becomes an opening through which trash bags are dispensed. As with LeCaire, more than one bag at a time may be inadvertently withdrawn or succeeding products may be damaged in an effort by the user to tear off one bag at a time.

Overall, these patents do not address the need for an inexpensive sheet material dispensing apparatus which is both simple and inexpensive to produce, and in which sheet-like material can be quickly replaced. Additionally, none of the disclosed devices in the prior art teach a device with a flexible top which may be positioned against the bottom of a horizontal surface, such as a cabinet or shelf, as well as a vertical surface, such as a wall, thereby conserving space. Additionally, none of the prior art devices disclose the combination of a pair of opposing rollers through which the product is fed, with one roller being pivotally supported by a flexible top with the above-mentioned advantages and the lower roller pivotally supported by the base of the device. Finally, none of the disclosed devices in the prior art teach a device having stabilizing rollers which are capable of dispensing sheet material which is stored not only in a roll, but in folded or other various packages, as well.

Therefore, it is desirable to provide an inexpensive sheet material dispensing device in which the material to be dispensed can be easily and quickly replaced and dispensed. It is also desirable to provide a device which may be mounted in a variety of places, including tight spaces under countertops or vertical spaces, such as a wall. Additionally, it is desirable to provide a pair of rollers in combination with the above-mentioned flexible door to stabilize the dispensing of sheet material, and to apply enough pressure to the material to be dispensed so that perforations between successive portions may be easily torn without damaging the portion being dispensed. Finally, it is desirable to provide a device which can dispense sheet material stored in various packaging methods besides a roll.

SUMMARY OF THE INVENTION

This invention provides a simple compact apparatus for containing and dispensing sheet materials. The invention further possesses the attributes of a flexible lid which allows the invention to be opened for the replacement of dispensable materials without requiring a large area to accommodate a swinging rigid lid. The invention also accommodates sheet materials sold in a variety of packaging methods and allows the quick and easy replacement of sheet material to be dispensed.

Essentially, the invention carries out four goals, although other advantages will be obvious to those skilled in the art. First, it is easily and economically manufactured, thereby being widely available to the public at low cost. Second, the apparatus is easy to use; the device allows perforated sheet materials to be easily torn from a succeeding material and allows for easy replacement of the sheet material supply. Third, the device dispenses sheet material contained in a variety of packages, thereby being easily adaptable to dispensing various sheet materials. Fourth, the configuration of the device conserves space. The compact motion of the flexible top eliminates the need for space in which to open a rigid lid.

In the preferred embodiment of the present invention, a single plastic piece is formed to provide a lower rectangular box cavity with two flat, upstanding, semi-cylindrical walls. The semi-cylindrical walls extend upward from and are parallel to each outside wall of the lower rectangular box. On the inside face of each semi-cylindrical wall, around its perimeter, is an inward facing, generally U-shaped slot. Both slots together form a track. Each outside wall of the lower rectangular box portion has formed, along the back and bottom of the lower rectangular box, a similar inward facing, U-shaped slot. Both slots in the lower rectangular box portion also form a track. The track in the upstanding, semi-cylindrical portions mates with the track in the outside faces of the lower rectangular box, thereby forming a continuous track from the forward perimeter of the upstanding semi-cylindrical walls to the back and underneath the lower rectangular box.

A "roll top" style flexible door is placed within the continuous track formed by the semi-cylindrical walls, the back and bottom of the lower rectangular box. "Roll top" style doors generally are formed by multiple thin, rigid ribs interconnected by a flexible webbing. The "roll top" style flexible door extends around the outer perimeter of the two semi-cylindrical walls.

In operation, the "roll top" flexible door can be slid forward forming a closure between the outside perimeter of each upstanding, semi-cylindrical wall and the top of the lower rectangular box. In its open position, the "roll top" flexible door is slid backward in the continuous track, and downward into below the lower rectangular box.

On the leading edge of the "roll top" flexible door, a cylindrical roller is pivotally mounted. Similarly, a second cylindrical roller is pivotally mounted on the top of the lower rectangular section where the forward perimeter of the upstanding semi-cylindrical walls meet the upper edge of the lower rectangular box. The second roller is mounted parallel to the roller mounted on the leading edge of the "roll top" flexible door. When in its closed position, the "roll top" flexible door forces the first roller into linear contact with the second roller forming a press fit therebetween.

Inside the lower rectangular box of the preferred embodiment, a drawer guide is formed by a parallel opposing slot formed on the interior of each outside wall of the lower rectangular portion. The preferred embodiment also includes a drawer formed from a single piece of plastic with mating projections on each side. The mating projections movably slide into each opposing drawer guide on the interior of the lower rectangular portion, thereby allowing the drawer to be easily moved into and out of the lower rectangular box.

DETAILED DESCRIPTION OF THE PREFERRED EMBODIMENT

Figure 1:
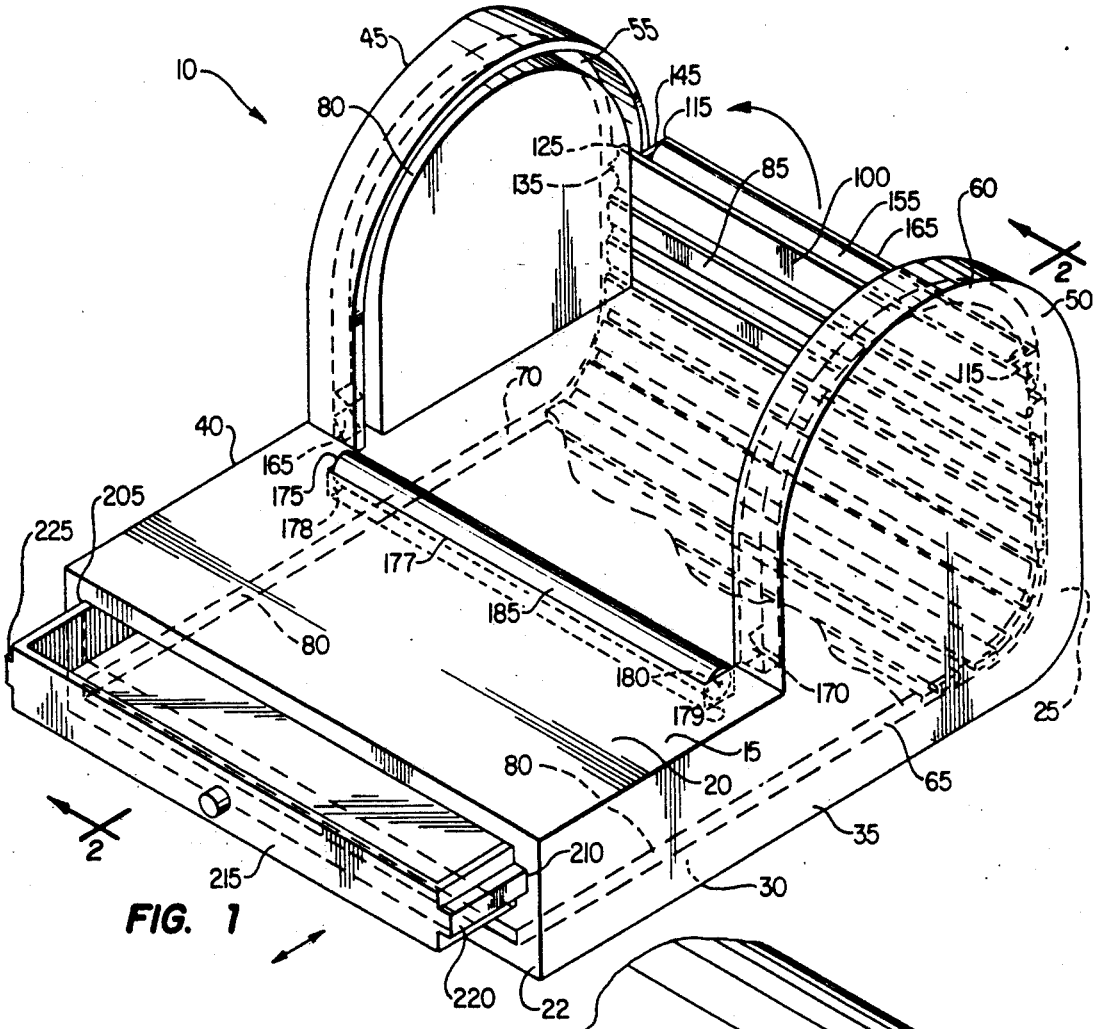
FIG. 1 is a perspective view of the sheet material dispensing apparatus showing placement of the "roll top" flexible door within the track.

FIG. 1 illustrates a perspective view of the sheet material dispensing apparatus 10. The preferred embodiment of the sheet material dispensing apparatus includes a lower rectangular box portion 15. The lower rectangular box portion 15 has a top surface 20, a front surface 22, a back surface 25, a bottom 30, and two opposing side walls 35 and 40. Opposing side walls 35 and 40 are parallel. Formed integrally with top surface 20 are two upstanding semi-cylindrical walls 45 and 50. Upstanding semi-cylindrical walls 45 and 50 are rigid and parallel. Formed integrally on the outside perimeter of upstanding semi-cylindrical wall 45 is an inward facing, generally U-shaped slot 55. Similarly, an inwardly facing, generally U-shaped slot 60 is integrally formed in the outside perimeter of semi-cylindrical wall 50. Generally U-shaped slots 55 and 60 directly face one another and are parallel and co-axial. Opposing side wall 35 of lower rectangular box portion 15 also includes an inward facing, generally U-shaped slot 65. U-shaped slot 65 extends downwardly along the back of opposing side wall 35 and gently curves forward to become parallel with the lower edge of opposing side wall 35 until it reaches the front surface 22 of lower rectangular box portion 15. Similarly, an inwardly facing, generally U-shaped slot 70 is integrally formed into opposing side wall 40. Slot 70 extends along the back edge of side wall 40 and gently curves to become parallel with the bottom edge of side wall 40 and extends to the front surface 22 of lower rectangular portion 15. Throughout their length, slots 65 and 70 are parallel.

Generally U-shaped slot 55 has the same dimensions as generally U-shaped slot 70. In the preferred embodiment, U-shaped slot 55 at the bottom of upstanding, semi-cylindrical wall 45 is placed directly over U-shaped slot 70, thereby forming a continuous slot around the perimeter of upstanding, semi-cylindrical wall 45, downward along the back edge of side wall 40 and forward along the bottom edge of side wall 40 terminating at front surface 22 of lower rectangular box portion 15.

Similarly, generally U-shaped slot 60 has the same dimensions as generally U-shaped slot 65. In the preferred embodiment, U-shaped slot 60, at the perimeter of semi-cylindrical wall 50, is placed directly above slot 65, thereby forming a continuous track around the perimeter of semi-cylindrical wall 50 and downward along the back edge of opposing side wall 35 and forward along the bottom edge of side wall 35 terminating at the front surface 22 of lower rectangular box portion 15.

U-shaped slots 55, 70, 60, and 65 together form a parallel trackway 80.

Figure 2:
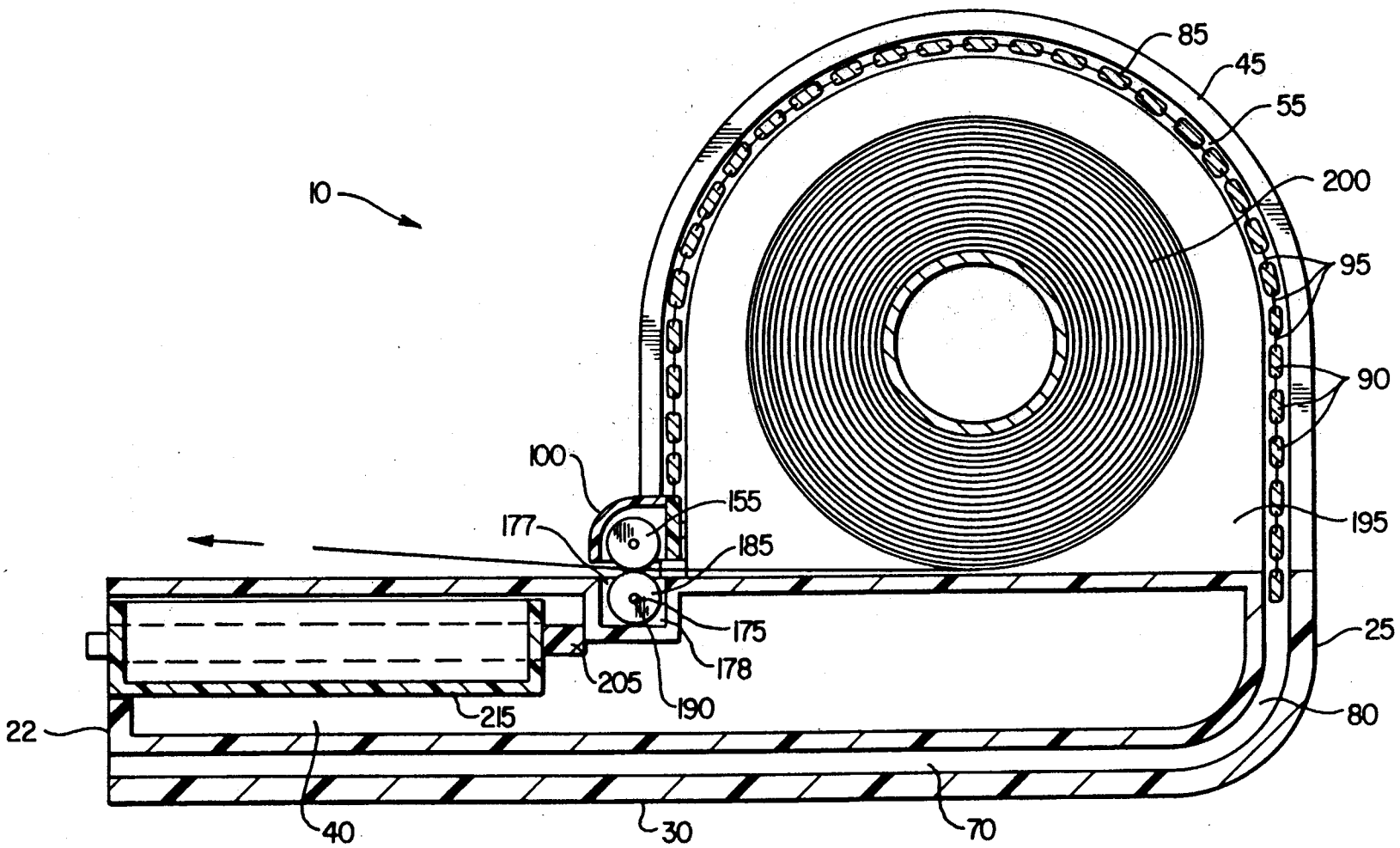
FIG. 2 is a cutaway side view of the sheet material dispensing apparatus showing the "roll top" flexible door in its closed position, and the placement of sheet material to be dispensed.

In the preferred embodiment, flexible "roll top" door 85 is slidably placed within parallel trackway 80. Referring to FIG. 2, flexible "roll top" door 85 includes numerous semi-rigid ribs 90 connected alternately between sections of flexible webbing 95. The connected pattern of semi-rigid ribs 90 and flexible webbing 95 creates a flexible door which is greatly flexible along an axis perpendicular to the axis of each semi-rigid rib 90, yet less flexible along an axis parallel to each semi-rigid rib 90. Each semi-rigid rib 90 has a cross-sectional diameter which is generally rectangular; however, the generally rectangular cross-section of each semi-rigid rib 90 is dimensioned to fit within parallel trackway 80. In the preferred embodiment, the flexible "roll top" door 85 is made of a pliable plastic, such as Teflon; however, other materials with similar properties are contemplated within the scope of the specification.

Figure 3:
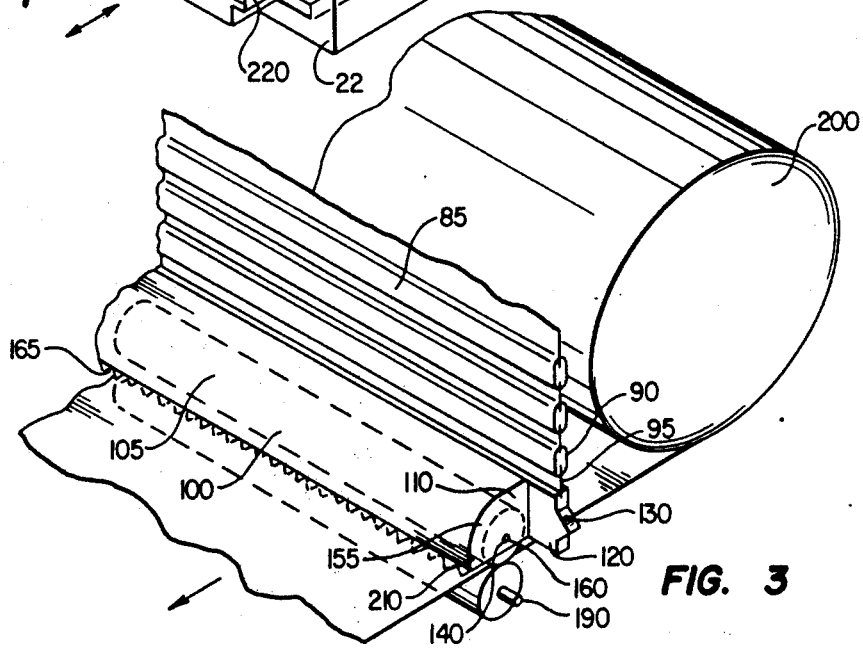
FIG. 3 is a perspective view of the leading edge of the "roll top" flexible door compressing a sheet material to be dispensed.

Referring to FIG. 3, at the leading edge of flexible "roll top" door 85, a rigid roller guard 100 is flexibly attached to the first section of flexible webbing 95 of flexible door 85. Roller guard 100 includes a semi-cylindrical shield 105 and two flat end portions 110 and 115 (as can be seen in FIG. 1). Rigid extension 120 extends outwardly from flat end portion 110. The width of rigid extension 120 is dimensioned to fit within U-shaped slots 55 and 70. Rigid extension 125 extends outwardly from flat end portion 115. The width of rigid extension 125 is dimensioned so that it fits within U-shaped slots 55 and 70. Extending outwardly from rigid extension 120 is lock latch 130. Similarly, extending outwardly from rigid extension 125 is lock latch 135 (as can be seen in FIG. 1). Roughly in the center of flat end portion 110 is a hole 140. Similarly, a hole 145 is included roughly in the center of flat end portion 115. Holes 140 and 145 are co-axial. Pivotally disposed between holes 140 and 145 is a flexible, cylindrical roller 155. In the preferred embodiment, flexible roller 155 is made of a pliable rubber; however, other substances having similar properties are contemplated in the scope of the specification. The axis of cylindrical roller 155 is held co-axial with holes 140 and 145 by pivot pin 160 which extends from hole 140 along the entire axis of cylindrical roller 155, and extending through hole 145.

Semi-cylindrical shield 105 has a front edge 165. In the preferred embodiment, front edge 165 is smooth, so that it will not tear thin plastic films or other flat products which are to be dispensed by the invention. In an alternate embodiment, front edge 165 is serrated (shown in phantom in FIG. 3). In the alternate embodiment, the serrated front edge is used to encourage linear tearing of sheet material such as paper towels or other paper products. Various other methods of cutting or encouraging linear tearing are contemplated within the specification.

Referring again to FIG. 1, the leading edge of generally U-shaped slot 55 on upstanding semi-cylindrical wall 45 includes a radial lock slot 165. Similarly, the leading edge of U-shaped slot 60 on semi-cylindrical wall 50 includes a radial lock slot 170. Radial lock slot 165 is parallel to radial lock slot 170.

Still referring to FIG. 1, the top surface 20 of lower rectangular box portion 15 includes a recessed slot 177 directly adjacent the leading edge of semi-cylindrical walls 45 and 50. Recessed slot 177 can also be seen in FIG. 2. At each opposing end of recessed slot 177 is an opposing face 178 and 179. Roughly in the center of opposing face 178 is a support hole 175. Roughly in the center of face 179 is a support hole 180. Support holes 175 and 180 are coaxial. Cylindrical roller 185 is placed between opposing face 178 and 179 coaxial with holes 175 and 180. Cylindrical roller 185 is pivotally held between opposing face 178 and 179 by pivot pin 190 which extends through hole 175, throughout the length of cylindrical roller 185 and through hole 180. In the preferred embodiment, cylindrical roller 185 is made of pliable rubber; however, other substances having similar properties are contemplated in the scope of the specification.

In the preferred embodiment, when the flexible "roll top" door 85 is brought to its closed position, thereby encircling the outer perimeter of both semi-cylindrical wall 45 and semi-cylindrical wall 50 with the exterior of flexible "roll top" door 85 and bringing cylindrical roller 55 is into linear contact with cylindrical roller 185. A pressure fit is created between cylindrical roller 155 and cylindrical roller 185 by the locking action of lock latch 135 expandably slipping into radial lock slot 165 and radial lock slot 170 respectively.

In operation, the flexible "roll top" door 85 of the preferred embodiment is found in its closed position, and the apparatus is assumed to have no sheet material within. The outer edge of roller guard 100 is grasped by the user and lifted upward. The lifting action dislodges lock latch 130 and lock latch 135 from radial lock slot 165 and 170, respectively. The upward motion further disengages cylindrical roller 185 from cylindrical roller 155.

As flexible "roll top" door 85 is pushed further upward and backward by the user, it slidably moves within parallel trackway 80 extending downward along the back edges of opposing side walls 35 and 40 and forward along the lower edges of side walls 35 and 40.

In its open position, flexible "roll top" door 85 allows an open space 195 between upstanding semi-cylindrical walls 45 and 50. Referring to FIG. 2, sheet material to be dispensed 200 can be easily placed in open space 195 by the user. The front edge of sheet material 200 is then easily played out by the user over cylindrical roller 185. Roller guard 100 is then grasped by the user and pulled forward and downward thereby sliding flexible "roll top" door 85 forward within parallel trackway 80. When in its fully closed position, lock latch 130 and 135 are again brought to rest within radial lock slots 165 and 170, thereby pressing cylindrical roller 155 into contact with the upper surface of the sheet of the material to be dispensed 200.

In the preferred embodiment, the sheet material to be dispensed is plastic trash bags. Plastic trash bags are often sold in a roll with perforations between each bag. As sheet material 200 is dispensed, the user grasps the first sheet and pulls forwardly. Cylindrical rollers 155 and 185 each being in pressed contact with sheet material 200, rotate oppositely thereby guiding and allowing further sheet material 200 to be dispensed. In the preferred embodiment, as the successive line of perforation in the material to be dispensed reaches and passes the linear intersection between cylindrical rollers 155 and 185, the user may easily separate successive bags due to the resistance created between cylindrical roller 155 and 185, and the resulting tension on sheet material 200.

In the preferred embodiment, the sheet material to be dispensed 200 is in rolled form. However, other packaging of sheet material may be alternately used for the roll material disclosed. In many instances, especially in the case of plastic trash bags, successively connected bags are sold folded in boxes. It can be seen that a package of folded bags could be easily placed within open space 195 and thereby dispensed by the invention.

In the preferred embodiment, an additional feature is added which adds to the utility of the apparatus as a whole. While not necessary to the functioning of the device, it is helpful to its overall utility.

Referring to FIG. 2, it can be seen that opposing side wall 40 includes an inwardly facing drawer slot 205, extending from front surface 22 toward the back surface 25 of lower rectangular box portion 15. A similar inwardly facing drawer slot 210 is formed on the interior of side wall 40 of lower rectangular box portion 15 (as can be seen in FIG. 1). Drawer slots 205 and 210 are parallel and coplanar. Referring to FIG. 1, a drawer 215 can be seen to have outwardly facing slide supports 220 and 225 on opposite sides. Slide supports 220 and 225 are dimensioned to fit within drawer slot 210 and 205 respectively, and allow drawer 215 to be slid inwardly toward back surface 25 of rectangular box portion 15.

Drawer 215 is provided in the preferred embodiment for storage of "twist ties" or other loose items used by manufacturers of plastic bags or other sheet material to be dispensed from the invention.

I claim:

1. A sheet material dispensing apparatus comprising:
a frame,
an arched trackway supported by said frame;
a pliable cover movably disposed within said arched trackway between a first position enclosing a supply of sheet material, and a second position exposing said sheet material,
a constricting slot, between said frame and said pliable cover to guide passage of said sheet material, and
a fastener adjacent said pliable cover to hold said pliable cover in said first position and narrow said constricting slot to apply pressure to said sheet material when said sheet material is dispensed.

2. The sheet material dispensing apparatus of claim 1, wherein said pliable cover is made of plastic.

3. The sheet material dispensing apparatus of claim 1, wherein said pliable cover is made of fabric.

4. The sheet material dispensing apparatus of claim 1, wherein:
said pliable cover pivotally supports a first cylindrical roller,
said frame pivotally supports a second cylindrical roller,
said constricting slot being formed between said first cylindrical roller and said second cylindrical roller when said pliable cover is in said first position.

5. The sheet material dispensing apparatus of claim 4 wherein said pliable cover supports tearing means, adjacent said sheet material, for tearing said sheet material.

6. A sheet material dispensing apparatus comprising:
a frame,
said frame further comprising two opposing side walls,
each of said side walls further comprising a rigid track,
a flexible door means, slidably disposed within said rigid track, for enclosing a supply of sheet material to be dispensed,
said flexible door means having an open and a closed position,
a stabilization means, attached to said frame and said flexible door means for gripping said sheet material while being dispensed, and
a lock means, adjacent said rigid track, for holding said flexible door means in said closed position and pressing said stabilization means into gripping relation with said sheet material.

7. The sheet material dispensing apparatus of claim 6, wherein said stabilization means further comprises:
a first roller means, pivotally attached to said flexible door means, for engaging the top surface of said sheet material when said flexible door means is in said closed position,
a second roller means pivotally attached to said frame, for engaging the bottom surface of said sheet material when said flexible door means is in said closed position, and
said flexible door means further positioned to slidably place said first roller means directly adjacent and parallel to said second roller means.

8. The sheet material dispensing apparatus of claim 6, wherein said stabilization means further comprises:
a tearing means held directly adjacent said sheet material when said flexible door means is held in said closed position by said lock means, for tearing said sheet material to be dispensed.

9. The sheet material dipensing apparatus of claim 6, wherein said lock means further comprises:
a first mating surface attached to said flexible door means,
a second mating surface attached to said frame to lockingly engage said first mating surface when said flexible door means is in said closed position.

10. The sheet material dispensing apparatus of claim 6 wherein:
said frame supports a second rigid track, and
said second rigid track slidably supports a drawer means for holding loose items.

11. The sheet material dispensing apparatus of claim 6, wherein:
said frame forms an enclosure and,
said enclosure forms a storage compartment.

12. A sheet material dispensing apparatus comprising:
a rigid frame having a supporting shelf and two upstanding semi-circular walls,
said supporting shelf forming a rigid box with two downwardly disposed, generally rectangular sidewalls parallel to said upstanding semi-circular walls,
each said generally rectangular sidewall having a lower edge,
a track formed on the outside perimeter of each semi-circular wall extending around the lower edge of each generally rectangular sidewall,
a resilient hatch having a leading edge perpendicular to said tracks, slidably disposed within said tracks between an open position and a closed position,
said resilient hatch forming an enclosure with said supporting shelf when in said closed position, and stored in said track on said rectangular sidewalls when in said open position, and a stabilizing means, attached to said rigid frame, for guiding passage of sheet material to be dispensed.

13. The sheet material dispensing apparatus of claim 12 wherein said stabilizing means further comprises:

a first stabilizing roller pivotally attached and parallel to said leading edge, a second stabilizing roller pivotally attached to said frame parallel to said first stabilizing roller, said first stabilizing roller rotatably contacting said second stabilizing roller when said resilient hatch is in said closed position.

14. The sheet material dispensing apparatus of claim 12 further comprising:

a compartment means, attached to said frame for storage of small items.

15. The sheet material dispensing apparatus of claim 12, wherein said stabilizing means further comprises:

a serrated guard means, held adjacent said sheet material to be dispensed by said stabilizing means for tearing of said material to be dispensed.

16. The sheet material dispensing apparatus of claim 12, wherein said resilient hatch is made of plastic.

17. The sheet material dispensing apparatus of claim 12, wherein said resilient hatch is made of fabric.

18. A method of dispensing connected trash can liners from a sheet material dispensing apparatus comprising a frame supporting an arched trackway, a pliable cover slidably disposed within said arched trackway between an open and closed position, a first roller pivotally attached to said pliable cover and a second roller pivotally attached to said frame, and a fastener adjacent said pliable cover to hold said pliable cover in said closed position, comprising the steps of:

sliding said pliable cover to said open position, placing said trash can liners adjacent said arched trackway, extending said trash can liners across the second roller, sliding said pliable cover to said closed position whereby said first roller is brought into contact with said trash can liners, and locking said pliable cover into said closed position with said fastener whereby said fastener causes said trash can liners to be gripped by said first roller and said second roller.

19. A method of dispensing sheet material from a sheet material dispensing apparatus comprising a frame supporting by an arched trackway, a pliable cover slidably disposed within said arched trackway between an open and closed position, a first roller pivotally attached to said pliable cover and a second roller pivotally attached to said frame, a fastener adjacent said pliable cover to hold said pliable cover in said closed position, and an edge closely adjacent said sheet material, comprising the steps of:

sliding said pliable cover to said open position, placing said sheet material adjacent said arched trackway, extending said sheet material across the second roller, sliding said pliable cover to said closed position, locking said pliable cover into said closed position with said fastener whereby said fastener causes said sheet material to be gripped by said first roller and said second roller, and pulling said sheet material across said edge whereby said sheet material is torn.

* * * * *